US007693599B2

(12) United States Patent
Okamoto

(10) Patent No.: US 7,693,599 B2
(45) Date of Patent: Apr. 6, 2010

(54) METHOD OF KNITTING KNITTED FABRIC, KNITTING PROGRAM FOR KNITTING KNITTED FABRIC, AND KNITTED FABRIC

(75) Inventor: Kazuyoshi Okamoto, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 343 days.

(21) Appl. No.: 11/721,087

(22) PCT Filed: Dec. 5, 2005

(86) PCT No.: PCT/JP2005/022319

§ 371 (c)(1),
(2), (4) Date: Jun. 7, 2007

(87) PCT Pub. No.: WO2006/062068

PCT Pub. Date: Jun. 15, 2006

(65) Prior Publication Data

US 2009/0173108 A1 Jul. 9, 2009

(30) Foreign Application Priority Data

Dec. 9, 2004 (JP) ..... 2004-357334

(51) Int. Cl.
*G06F 19/00* (2006.01)

(52) U.S. Cl. ..... 700/141; 66/175

(58) Field of Classification Search ..... 700/141, 700/130; 66/64, 73, 69, 175
See application file for complete search history.

(56) References Cited

U.S. PATENT DOCUMENTS 6,550,284 B2 * 4/2003 Okamoto ..... 66/69
6,658,899 B2 * 12/2003 Okamoto ..... 66/64
6,796,149 B2 * 9/2004 Okamoto et al. ..... 66/64
6,918,270 B2 * 7/2005 Yui ..... 66/176
7,143,613 B2 * 12/2006 Takimoto ..... 66/64
7,225,646 B2 * 6/2007 Okamoto ..... 66/176
7,481,078 B2 * 1/2009 Okamoto ..... 66/70
7,539,555 B2 * 5/2009 Okamoto ..... 700/141

FOREIGN PATENT DOCUMENTS

JP 65826/1988 11/1989
JP 11-256456 A 9/1999
JP 2002-242052 B2 8/2002

* cited by examiner

*Primary Examiner*—Danny Worrell
(74) *Attorney, Agent, or Firm*—Rothwell, Figg, Ernst & Manbeck, P.C.

(57) ABSTRACT

A knitting method is provided to knit a knitted fabric to the desired shape with sufficient pull down force acting to the knitted fabric without being piled up, when performing the bind off process after flechage knitting.

The knitting method is related to knitting a knitted fabric of performing a bind off process after flechage knitting by using a flat knitting having at least a pair of front and back needle beds extending in a transverse direction and disposed opposite to each other in a cross direction, at least either of which is capable of being racked in the transverse direction so that loops can be transferred between the front and back needle beds.

In knitting of narrowing a knitting width with flechage knitting, knitting a predetermined number of courses with flechage knitting by feeding a yarn from a flechage knitting yarn feeder, and binding off at least one loop held on a knitting needle without forming a stitch at the end of the knitting width by feeding a yarn from a bind off process yarn feeder different from the flechage knitting yarn feeder, and knitting steps are repeated.

5 Claims, 3 Drawing Sheets

METHOD OF KNITTING KNITTED FABRIC, KNITTING PROGRAM FOR KNITTING KNITTED FABRIC, AND KNITTED FABRIC

Cross Reference to Related Application

This application is a 35 USC § 371 National Phase Entry Application from PCT/JP2005/022319, filed Dec. 5, 2005, and designating the U. S.

TECHNICAL FIELD

The present invention relates to a method of knitting a knitted fabric of in which a bind off process is performed after flechage knitting, a knitting program for knitting the knitted fabric with a flat knitting machine, and the knitted fabric.

BACKGROUND ART

Knitted fabrics performed with flechage knitting and thereafter the bind off process at the portion performed with flechage knitting include cases of forming shoulder drops at the shoulder portions of the body in clothes such as sweater.

When forming the shoulder drops at the shoulder portions of the body, the left and right shoulder portions of the front body and the shoulder portions of the back body are knitted through flechage knitting so that the knitting width gradually narrows. In this flechage knitting, the number of stitch is reduced at a neckline forming portion since a neckline is usually formed in the body. Therefore, when flechage knitting is performed, the loops at the end of the neckline side and the end of the armhole side of the knitting width are sequentially held on resting needles every time the knitting width is narrowed. After flechage knitting is completed, the loops of the shoulder portion held on the resting needles are sequentially bound off starting from the end of the armhole side (see e.g., patent document 1).

Patent document 1: Japanese Patent Publication No. 2002-66722

DISCLOSURE OF THE INVENTION

Problem to be Solved by the Invention

As described above, the loops that are not knitted are held on knitting needles in the resting needles from the end of the knitting width while performing flechage knitting.

If the angle of the shoulder drop is to be made large or the neckline is to be made large, the number of courses to be knitted with flechage knitting increases. If the number of knitting courses to be knitted with flechage knitting increases, the loops of the knitted fabric are held on the resting needles from the end of the knitting width. Thereby, the pull down force becomes difficult to act on the portion of the knitted fabric knitted with flechage knitting as the number of loops held on the resting needles increases. As a result, since the knitted fabric does not drop towards the lower side of the needle bed gap of the knitting machine, pile us of the knitted fabric is produced during knitting, and then, knitting may not be performed.

In particular, when knitting the shoulder portions of the front body, each shoulder region is knitted with flechage knitting so that the loops are held on the resting needles from both ends of the knitting width since the neckline is also formed. That is, the portion to be knitted with flechage knitting of the shoulder portions of the knitted fabric sequentially narrow towards the center portion of the knitting width, and the area of the portion held on the resting needles at both ends of the knitting width increases. When the knitted fabrics are held on the resting needles at both ends of the knitting width, the pull down force further becomes difficult to act on the portion of the knitted fabric knitted with flechage knitting compared to when held on the resting needles only at one end of the knitting width.

Therefore, conventionally, when the number of knitting courses of flechage knitting increases, the knitted fabric is piled up, and then, knitting may not be performed and thus knitting cannot be performed to obtain the shape of the ideal shoulder region shown with a double chain-dashed line 100 of FIG. 5. Therefore, because the number of knitting courses of flechage knitting must be reduced, as shown with a solid line 200 of FIG. 5, the neckline and the shoulder drop of sufficient size could not be obtained.

The method of knitting a knitted fabric and the knitting program for knitting with a flat knitting machine of the present invention have been developed in view of the above actual conditions. They aim to knit a knitted fabric to the desired shape with sufficient pull down force acting to the knitted fabric without being piled up, when performing the bind off process after flechage knitting.

Means for Solve the Problem

A method of knitting a knitted fabric of the present invention is a method of knitting a knitted fabric of performing a bind off process after flechage knitting by using a flat knitting machine having at least a pair of front and back needle beds extending in a transverse direction and disposed opposite to each other in a cross direction, at least either of which is capable of being racked in the transverse direction so that loops can be transferred between the front and back needle beds.

The method of knitting the knitted fabric of the present invention comprises, in knitting to narrow a knitting width through flechage knitting, knitting step for a predetermined number of courses less than the number of entire knitting courses in the number of entire knitting courses to be continuously knitted with flechage knitting to narrow the knitting width by feeding a yarn from a flechage knitting yarn feeder, binding off step subsequent to the knitting step for binding off at least one loop held on a knitting needle without forming a stitch at the end on the knitting width feeding a yarn from a bind off process yarn feeder different from the flechage knitting yarn feeder after the predetermined number of flechage knitting courses is knitted, and repeating the knitting step of the predetermined number of courses with flechage knitting and binding off step so that the knitting width is narrowed through flechage knitting while the loops in a resting state at the end of the knitting width are sequentially bound off.

In the present invention, a yarn used in flechage knitting, and a yarn used in the bind off process are fed from different yarn feeders respectively to perform flechage kitting and bind off process. A predetermined number of loops are bound off in the binding off step after the predetermined number less than the number of the entire knitting courses in the number of the entire knitting courses to be continuously knitted with flechage knitting in the knitting step, and these steps are repeated. That is, at least one loop of the loops held on the knitting needles without forming stitches at the end of the knitting width is bound off after the predetermined number of courses is knitted with flechage knitting, and flechage knitting and binding off are repeated to knit the knitted fabrics. After knitting the number of entire knitting courses to be knitted with flechage knitting, all the loops held on the knitting needles are bound off.

In the knitting method described above, it is preferable that the number of entire knitting courses to be knitted with flechage knitting is divided to at least two course groups, and the loops held on the knitting needles without forming stitches at the end of the knitting width are bound off every time the predetermined number of flechage knitting course in each course group is knitted.

The number of entire knitting courses to be knitted with flechage knitting refers to the knitting courses required to be knitted with flechage knitting, for example, in case of knitting the shoulder drop at the left and right shoulder parts of the front body, the number of the courses are from the position at where joining to the sleeve is completed at the armhole part of the right or the left bodies of the front body to the position at where the end of the shoulder part on the neckline part side that becomes the top of the shoulder parts.

When referring to dividing the number of entire knitting courses to at least two course groups, for example, if the number of entire knitting courses are eight courses, the number of courses are divided to two groups of four courses each, to four groups of two courses each, or to two courses, four courses and two courses. Division into groups does not all need to be in the same number of courses, and may be set to have different number of courses.

If the number of entire knitting courses is eight courses and the course group is divided to four groups, the loops held on the knitting needles without forming stitches at the end of the knitting width, such as at the end of the front body at where the sleeve is joined, are bound off, and then the loops are released from the knitting needles every time two courses are knitted with flechage knitting starting from the course group on the set up side.

Therefore, in the method of knitting the knitted fabric of the present invention, the loops in a resting state at the end of the knitting width are sequentially bound off so that the loops are released from the knitting needles while the knitting width is simultaneously narrowed through flechage knitting, and thus pile up of the knitted fabrics are prevented from being produced during flechage knitting.

By the way, in the bind off process, at least one loop held on the knitting needle without forming the stitch at the end of the knitting width after flechage knitting is directly bound off by feeding a yarn from the bind off process yarn feeder. In this case, a new yarn is fed from a bind off process yarn feeder different from the flechage knitting yarn feeder to the loops held on the resting needles to bind off the loops.

Further, in the bind off process, a new loop as an adjustment stitch may be formed in continuation to at least one loop held on the knitting needle without forming the stitch at the end of the knitting width after flechage knitting by feeding the yarn from a yarn feeder different from the flechage knitting yarn feeder and the bind off process yarn feeder, and then, the new loop can be bound off with the yarn fed from the bind off process yarn feeder.

In the present invention, even if two loops are held on one resting needle by tucking in time of flechage knitting, when a new loop is formed in continuation to the loops held on the resting needle, the old loops are released from the knitting needle by the new loop, and the new loop is held on the knitting needle.

In the present invention, the new loop continuing to the old loops is formed on not only the knitting needle holding the double loops described the above but also the knitting needle holding a loop formed by the flechage knitting, and then, these new loops are bound off.

As described above, in the knitting method of the present invention, after the predetermined number of courses in knitting with flechage knitting, the adjustment stitches (the new loops, as described hereinbefore) for aligning the stitches are formed following these stitches (loops being held) knitted with flechage knitting, and then, the new loops are bound off while yarns are changed according to each process, each yarn, the yarn used in flechage knitting, the yarn used in forming the adjustment stitch, and the yarn used in bind off process, is fed from different yarn feeder, respectively.

In the present invention, the new loops that become the adjustment stitches are continuously formed to the loops knitted with flechage knitting, and such new loops are bound off, so that the bind off loops can continuously be in the state of uniform size. Accordingly, the bind off loops of beautiful outer appearance can be formed. Therefore, the state of the bind off loops is uniformed as a whole, as a result, the outer appearance becomes more beautiful compared to when the double loops held on one resting needle formed by tucking through flechage knitting are bound off.

The method of knitting the knitted fabric of the present invention is not only limited to sweaters and cardigans, and can be applied to other clothes such as pants as long as it is the knitted fabrics to be bind off processed after flechage knitting, and the present invention is not limited to knitting the knitted fabric of tubular shape, and is also applicable to knitting one knitted fabric such as the front and back bodies individually. Furthermore, the bind off process in the knitting method of the present invention can be applied when performing the bind off process on one side or both sides after performing the flechage knitting on both sides of the knitting width, and when performing the bind off process after performing the flechage knitting only on one side of the knitting width.

The present invention provides a program for a computer incorporated flat knitting machine to knit a knitted fabric of performing bind off process after flechage knitting based on commands, the flat knitting machine having at least a pair of front and back needle beds extending in a transverse direction and disposed opposite to each other in a cross direction, at least either of which is capable of being racked in the transverse direction so that loops can be transferred between the front and back needle beds, and the knitted fabric is knitted using the flat knitting machine using the program.

The knitting program of the present invention includes a flechage knitting setting command, a group setting command, and a knitting command. The flechage knitting setting command commands to set the number of entire knitting courses to be performed with flechage knitting. The group setting command commands to divide the number of entire knitting courses to be performed with flechage knitting into at least two groups. The knitting command commands to, in each course group, perform flechage knitting for a predetermined number of courses in each course group by feeding a yarn from a flechage knitting yarn feeder and perform bind off process on loops held on knitting needles without forming stitches at the end of a knitting width by feeding a yarn from a bind off process yarn feeder different from the flechage knitting yarn feeder after the predetermined number of flechage knitting course in each courses is knitted, the flechage knitting and the bind off process starting sequentially from a course group at a knitting start side.

The knitting program also includes a command to input the shape and dimension corresponding to each part of the knitting patterns designed by the user and record the knitting patterns. Furthermore, a selecting command to select the knitting procedure such as bind off process, widening stitch, the narrowing stitch, the flechage knitting etc. in relation to the recorded knitting patterns is further provided.

The knitting program is created in the CAD device, and the created program is stored on a recording medium such as disc. The recording medium is read with the computer incorporated in the flat knitting machine, and each mechanism of the flat knitting machine is driven to knit a knitted fabric according to each command by the program.

The CAD device includes the following means and memories. An input means for inputting shapes and dimensions of the knitting patterns designed by the user. A memory for recording the shape and dimension of the knitting fabrics input with the input means. A memory for storing knitting procedures such as bind off process, widening stitch, narrowing stitch, flechage knitting etc. necessary in performing knitting. A program creating means for selecting the knitting procedure for knitting the knitted fabric from the knitting patterns stored in the memory, and creating the knitting program for knitting the knitted fabric with the flat knitting machine based on the knitting patterns. An output means for outputting the program to the recording medium.

The knitting patterns refer to the shapes of the front body, the back body, and the left and right sleeves when knitting the sweater, and the front body, the back body, and the left and right sleeves are referred to as parts.

By driving the flat knitting machine according to the knitting command of the knitting program of the present invention, the knitted fabric of beautiful outer appearance can be automatically knitted without producing pile up in the knitted fabrics when the flechage knitting is performed and the bind off process is processed after the flechage knitting is performed.

EFFECT OF THE INVENTION

According to the knitting method of the present invention, after knitting the predetermined number of courses less than the number of entire knitting courses in the number of the entire knitting courses to be continuously knitted with flechage knitting, a predetermined number of loops are bound off, and these steps are released. Consequently, the loops are gradually released from the knitting needles by binding off the loops in a resting state at the end of the knitting width while narrowing the knitting width through flechage knitting simultaneously. Thus, the pile up is prevented from producing at the portion performed with flechage knitted even if the number of entire knitting courses of the flechage knitting is increased.

In particular, the neckline is knitted to be large and the shoulder drops are knitted to the desired shape without producing pile ups in the knitted fabrics during knitting, by applying the knitting method of the present invention when knitting the shoulder parts of the front body.

The knitted fabric can be automatically knitted without producing pile ups at the knitted fabrics during flechage knitting by knitting the knitted fabric using the flat knitting machine using the knitting program of the present invention.

DETAILED DESCRIPTION OF THE PREFERRED EMBODIMENTS

The preferred embodiments of the present invention will now be described in detail below with reference to the drawings. First, a first embodiment serving as one preferred embodiment of the present invention will be described based on FIG. 1 to FIG. 3.

The present embodiment manufactures a knitwear using so-called a two-bed flat knitting machine having a pair of front and back needle beds extending in a transverse direction and disposed opposite to each other in a cross direction, the back needle bed is capable of being racked in the transverse direction so that loops can be transferred between the front and back needle beds.

The two-bed flat knitting machine performs knitting using every alternate needle for each front and back needle bed when knitting a tubular knitwear. For example, odd needles of the front needle bed are mainly used to knit front parts of the knitwear such as the front body, front parts of the sleeve etc., and even needles of the back needle bed are mainly used to knit the back parts of the knitwear such as the back body, back parts of the sleeve etc.

Furthermore, when using the two-bed flat knitting machine, the back knitted fabrics are held on the needles of the back needle bed when knitting the front knitted fabrics, and the front knitted fabrics are held on the needles of the front needle bed when knitting the back knitted fabrics so as to knit the knitted fabric with the front and the back knitted fabrics parts in an overlapping state, whereby the front and back knitted fabrics parts constantly ensure empty needles for transferring loops on the opposing needle bed.

The structure patterns in which the front stitches and the back stitches are mixed such as links, purls, ribs etc. can be knitted, and the loops of the sleeves and the bodies can be moved in the course direction to join with each other by using the empty needles.

When using the two-bed flat knitting machine, a transfer jack bed having transfer jacks arranged in line may be disposed above either or both of the front and back needle to knit the knitted fabrics.

In the present embodiment, the knitwear is knitted using the two-bed flat knitting machine, but the present invention includes knitting using a four-bed flat knitting machine including an upper front needle bed, a lower front needle bed, an upper back needle bed and a lower back needle bed.

When using the four-bed flat knitting machine, for example, the front knitted fabric parts are held on the lower front needle bed and the back knitted fabric parts are held on the lower back needle bed. The needles of the upper back needle bed are used as the empty needles to transfer the loops of the front knitted fabric parts, form back stitches etc. When knitting the back knitted fabric parts, the needles of the upper front needle bed are used as the empty needles to transfer the loops of the back knitted fabric parts, form back stitches etc.

In the present embodiment, the body and sleeve parts configuring the knitwear are knitted into a seamless tubular shape using the two-bed flat knitting machine.

FIG. 1 is a plan view of the parts of the body parts and the sleeve parts of a sweater 1 of the knitwear. FIG. 2 shows the knitting state when knitting the shoulder portions of the sweater. FIG. 3 shows a flow chart of knitting of the knitting method of the present invention.

The sweater 1 knitted in the present embodiment is a long-sleeved sweater having a round neckline, and includes a front body 2*a*, a back body 2*b*, a right sleeve 4 and a left sleeve 3. The front body 2*a* and the back body 2*b* include rib parts 21, side parts 22, armhole parts 23, shoulder-line parts 24, and a neckline part 25. In the present embodiment, the front body 2*a* and the back body 2*b* have different shapes at the upper side from points B, b, which are the positions the neckline part 25 to be formed.

In the present embodiment, the front body 2*a* and the back body 2*b* in the body portion are knitted to a tubular shape, and left and right sleeves 3, 4 are also knitted to tubular shapes, respectively. The terms expressing, left and right of the body and the sleeve, such as right and left in the left sleeve 3 and the right sleeve 4 are defined with the person wearing the sweater 1 as the reference in the present embodiment and the second embodiment.

The knitting procedures of the sweater 1 of the present embodiment will now be described. In the present embodiment, the back body 2*b*, the back knitted fabrics of the right sleeve 4, and the back knitted fabric of the left sleeve 3 are knitted using mainly of even needles on the back needle bed. The front body 2*a*, the front knitted fabric of right sleeve 4, and the front knitted fabric of the left sleeve 3 are knitted using mainly odd needles on the front needle bed.

For convenience of explanation, the knitting patterns of the front body 2*a*, the back body 2*b*, and sleeves 3, 4 of the sweater 1 are assumed to be solid of plain stitches, and the rib parts 21 of the front body 2*a* and the back body 2*b*, and the cuff portions 31, 41 of the sleeves 3, 4 are rib knitted. However, the front body 2*a*, the back body 2*b*, the right sleeve 4, and the left sleeve 3 may be knitted in structure patterns such as jacquard, rib and the like.

First, three yarn feeders for knitting the body and for knitting left and right sleeves are prepared, and the yarn is fed from each yarn feeder to the needles of the needle bed to knit three tubular bodies of the right sleeve, the body and the left sleeve.

Specifically, the front body 2*a* and the back body 2*b* are knitted in a tubular shape from the rib up to the starting positions (A, a) for joining to the sleeves, as shown in FIG. 1. The left sleeve 3 and the sleeve 4 are knitted in tubular shape respectively from the cuffs to the positions (F, f) for joining to the body. The body and the sleeves begin to be joined at point A of the body and point F of the left sleeve 3, as well as at point a of the body and point f of right sleeve 4, so that the front and back bodies 2*a*, 2*b*, the left sleeve 3 and the right sleeve 4 are integrated to form a tubular body.

The armhole parts 23 of the bodies are formed from the upper end (positions A, a of FIG. 1) of the side-parts 22 up to the points (C, c) that become the ends of the shoulder-line parts 24. In the present embodiment, point B of the armhole part 23 and point G of the left sleeve 3 are joined, and point b of the armhole part 23 and point g of the right sleeve 4 are joined. Thereafter, point C of the armhole parts 23 and point H of the left sleeve 3 are joined, and point c of the armhole part 23 and point h of the right sleeve 4 are joined, whereby the joining of the body parts and the sleeve parts are completed.

The shoulder-parts 24 of the front body 2*a* are formed from the upper ends (positions C, c of FIG. 1) of the armhole part 23 towards the neckline part 25. The shoulder-line parts 24 are formed along one's shoulder line when wearing the knitwear. The shoulder-line parts 24*a* of the front body 2*a* are inclined downward from the neckline side towards the sleeve sides by forming shoulder drop knitting parts 26 of triangular shape at the shoulder portions.

The back body 2*b* also has the shoulder-line parts 24 formed from the upper ends (positions C, c of FIG. 1) of the armhole parts 23 towards the neckline part 25 as shown in FIG. 1. The shoulder-line parts 24 of the back body 2*b* are inclined downward from the neckline side towards the sleeve sides similar to the front body 2*a* by forming a shoulder drop knitting part 27 of trapezoidal shape at the shoulder portion.

In the present embodiment, the shoulder drop knitting part 27 of the back body 2*b* is first knitted with flechage knitting as shown in FIG. 2 after the body and the sleeves are joined. In flechage knitting, the loops forming the shoulder-line part 24 are held on the resting needles of the back needle bed.

Subsequently, the shoulder drop knitting part 26 on the left side of the front body 2*a* is knitted with flechage knitting, and the shoulder drop knitting part 26 on the right side is similarly knitted with flechage knitting after the shoulder drop knitting part 26 on the left side is knitted. In the present embodiment, the left and right shoulder drop knitting parts 26 are knitted by the knitting method of the present invention, i.e. performing bind off process while performing flechage knitting.

In the case of the present embodiment, the pile up of the knitting fabric is less likely to be produced on the back body even if the loops are held on the needles since the knitting width of the neckline part of the back body is wide, and the knitting method of the present invention in which the bind off process is performed while performing flechage knitting is not applied to the back body. However, the left and right shoulder drop knitting parts of the front and back bodies may be simultaneously knitted by the knitting method of the present invention in which the bind off process is performed while performing flechage knitting.

Specifically, the knitting method will be described based on FIG. 3. In the present embodiment, the description will be made only on the shoulder drop knitting part 26 on the left side, but the shoulder drop knitting part 26 on the right side is knitted in a similar manner so as to be symmetrical. In FIG. 3, only the knitting steps of the front body 2*a* are shown, and the operations of joining the loops of the front and back shoulder-line parts of the front body and the back body, and the operation of bind off process are omitted, but various known knitting methods may be used for the omitted operations. The alphabets shown at the lower part of FIG. 3 indicate the needle of the front needle bed, and the numbers on the left show the steps.

Regarding the knitting of the shoulder drop knitting part 26, the yarn is fed from flechage knitting yarn feeder (1), and one course from the upper end of the armhole part 23 (positions C, c of FIG. 1) up to the position of the neckline part 25 (knitting needle x) is knitted (step 1). After returning and tucking to the knitting needle y on the neckline side end, one course up to the knitting needle g is knitted (step 2), and subsequently, after returning and tucking to the knitting needle f, one course up to the knitting needle w is knitted (step 3). This is the first course group.

After the first course group is knitted with flechage knitting, a new yarn is fed to the knitting needle a from a bind off process yarn feeder (2) different from flechage knitting yarn feeder (1), and the loop held on the knitting needle a to the loop held on the knitting needle h are bound off (step 4). The loops held on the knitting needles a to h are thereby released from the knitting needles by the bind off process of step 4.

After the bind off process up to the knitting needle h is completed, the yarn fed from flechage knitting yarn feeder (1) is returned and tucked to the knitting needle x on the neckline side, and one course up to the knitting needle j is knitted (step 5), and subsequently, after returning and tucking to the knitting needle i, one course up to the knitting needle v is knitted (step 6). Flechage knitting of these two courses become the second course group.

After the flechage knitting of the second course group, the loops held on the knitting needles i to k are bound off while feeding the yarn from the bind off process yarn feeder (2) as similarly in the previous bind off process (step 7).

After step 7, steps of step 5 to step 7 are repeated until the shoulder-line part is finished, that is, three loops are bound off every time two courses are knitted with flechage knitting.

Therefore, in the present embodiment, the loops at the end of the knitting width are gradually released from the knitting needles by binding off eight loops after flechage knitting of three courses in the first course group, and by binding off three loops every time flechage knitting of two courses in second and subsequent course groups. According to such knitting, sufficient pull down force towards the downward acts on the portion of the knitted fabrics to be knitted with flechage knitting, thereby preventing pile up of the knitted fabrics. Consequently, knitting can be performed so that the neckline is large and the inclination of the shoulder drop is large.

The loops held on the knitting needles formed through flechage knitting are directly bound off in the first embodiment. However, a new loop may be formed following the loops held on the knitting needles without forming stitches through flechage knitting, and such new loop is bound off, as shown in FIG. 4.

Specifically, in knitting the shoulder drop part 26 for this case, the yarn is fed from flechage knitting yarn feeder (1), and one course from the upper ends of the armhole part 23 (positions C, c of FIG. 1) up to the position of the neckline part 25 (knitting needle x) is knitted (step 1). After returning and tucking to the knitting needle y on the neckline side end, one course up to the knitting needle g is knitted (step 2), and subsequently, after returning and tucking to the knitting needle f, one course up to the knitting needle w is knitted (step 3). This is the first course group.

After the first course group is knitted with flechage knitting, a new yarn is fed to the knitting needle a from a stitch adjustment yarn feeder (3) different from flechage knitting yarn feeder (1), and new loops are formed on the loops held on the knitting needles a to e (step 4). A new yarn is then fed to the knitting needle a from a bind off process yarn feeder (2) as changing the yarn feeder, and loops held on the knitting needles a to c are bound off (step 5). Thereby, the loops held on the knitting needles a to c are released from the knitting needles by the bind off process of step 5.

After the bind off process up to the knitting needle c is completed, the yarn fed from flechage knitting yarn feeder (1) is returned and tucked to the knitting needle x on the neckline side, and one course up to the knitting needle j is knitted (step 6), and subsequently, after returning and tucking to the knitting needle i, one course up to the knitting needle v is knitted (step 7).

Flechage knitting of the two courses becomes the second course group. After the second course group is knitted with flechage knitting, new loops are formed on the loops held on the knitting needles f to h as adjacent to the loops newly formed in a previous step with a yarn fed from the stitch adjusting yarn feeder (3) (step 8). The loops held on the knitting needles d to f are bound off while feeding the yarn from the bind off process yarn feeder (2) as similarly in the previous bind off process (step 9).

After step 9, steps of step 6 to step 9 are repeated until the shoulder-line part is finished, that is, three new loops are formed on the loops held on the knitting needles, and three loops at the end of the knitting width held on the knitting needle are bound off every time two courses are knitted with flechage knitting.

In the second embodiment, new loops are formed on the loops held to right before tucking after flechage knitting of three courses in the first course group. In the second and subsequent course groups, three new loops are formed up to right before tucking every flechage knitting of two courses, and one loop of the three new loops is bound off while two loops of three new loops are remained being held on the knitting needles. In this manner, the state (shape, size) of the bind off loops all can become equal and continuous by forming new loops and binding off the new loops. As a result, the loops at the end of the knitting width are released from the knitting needles so that flechage knitting can be effectively performed while preventing production of pile up the knitted fabrics and enhancing the beautiful outer appearance. Further, the bind off process on the new loops is performed in a manner that one loop of the three new loops is remained being held.

In the second embodiment, the adjustment stitches (new loops) for aligning the stitches are formed on the loops (loops being held) knitted with flechage knitting, and the adjustment stitches are bound off to finish the shoulder drop knitting part 26 while the yarn used for flechage knitting, the yarn used in forming the adjustment stitches, and the yarn for bind off process are fed from different yarn feeders respectively.

In each embodiment, a knitting program for performing the knitting method of each embodiment described hereinbefore is created, and knitting is performed with the flat knitting machine using the knitting program. The knitting program is created with a CAD device, and the created program is stored on a recording medium such as a disc in the present embodiment. The recording medium is read by a computer incorporated in the flat knitting machine, and each mechanism of the flat knitting machine is driven to knit the knitted fabrics according to the knitting command by the program.

The CAD device includes the following means and memories. An input means for inputting shapes and dimensions of the knitting patterns designed by the user. A memory for recording the shapes and dimensions of the knitting fabrics input with the input means. A memory for storing knitting procedures such as bind off process, widening stitch, narrowing stitch, flechage knitting etc. necessary in performing knitting. A program creating means for selecting the knitting procedure for knitting the knitted fabrics from the knitting patterns stored in the memory, and creating the knitting program for knitting the knitted fabrics with the flat knitting machine based on the knitting patterns. An output means for outputting the program to the recording medium.

In the program creating means, the program of the command to record the knitting patterns, selecting command to select the knitting procedures, flechage knitting setting command, group setting command, bind off process knitting command, selecting command for selecting knitting procedures is created.

The command for recording the knitting patterns commands to record the knitting patterns based on the input data when shape and dimension corresponding to each part of the knitting patterns designed by the user are input.

The selecting command for selecting the knitting procedures commands to select the knitting procedure such as bind off process, widening stitches, narrowing stitches, flechage knitting and the like to knit the recorded knitting patterns.

Flechage knitting setting command commands to set the number of entire knitting courses to be performed with flechage knitting based on the knitting patterns when performing the bind off process after flechage knitting.

The group setting command commands to divide the set number of entire flechage knitting course into at least two course groups.

The bind off process knitting command commands to feed a yarn from the bind off process yarn feeder different from a flechage knitting yarn feeder and perform bind off process on the loops held on the knitting needles without forming stitches at the ends of the knitting width every time knitting is performed for the predetermined number of flechage knitting courses in each course group by feeding a yarn from the flechage knitting yarn feeder.

In the present embodiments, the knitting command is read by the computer incorporated in the flat knitting machine from the recording medium recorded with the knitting program, and the knitted fabrics are knitted according to the knitting command using the flat knitting machine. According to such knitting, the knitted fabrics having beautiful outer appearance when worn with large neckline and large inclination angle of the shoulder drop can be automatically knitted without producing pile ups in the knitted fabrics.

INDUSTRIAL APPLICABILITY

The knitting method and the knitting program of the present invention are suitable when knitting the knitted fabrics having shoulder drops and large neckline in a seamless manner using the flat knitting machine.

DESCRIPTION OF THE REFERENCE NUMBERS

Figure 1:
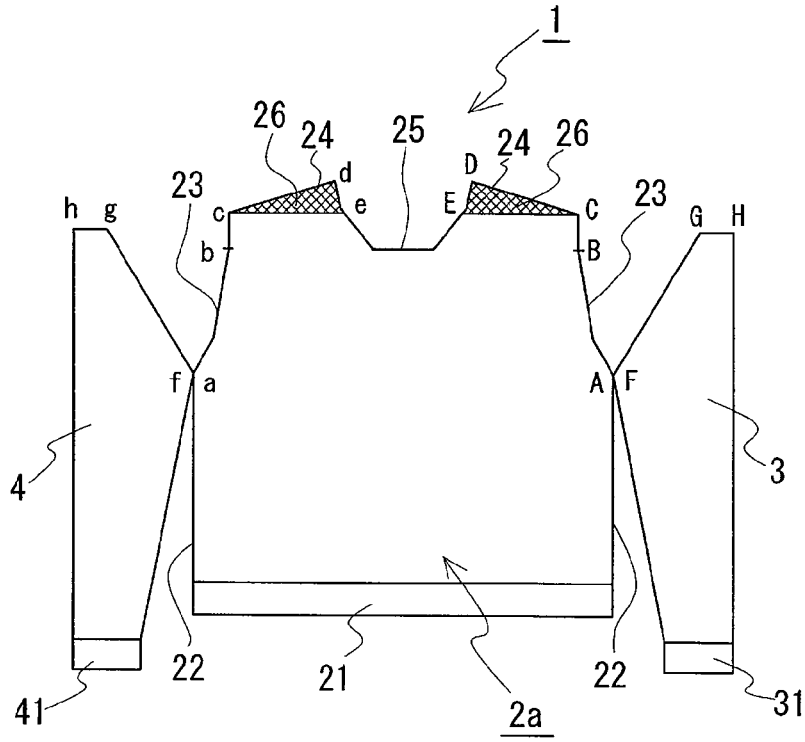
FIG. 1 is a plan view of the parts of knitwear according to the present invention.
Figure 1:
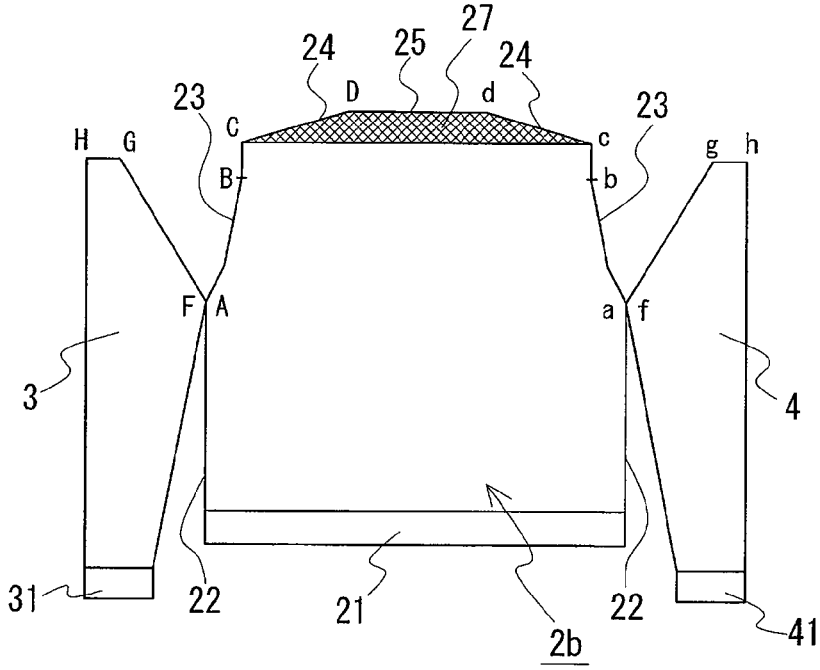
Figure 2:
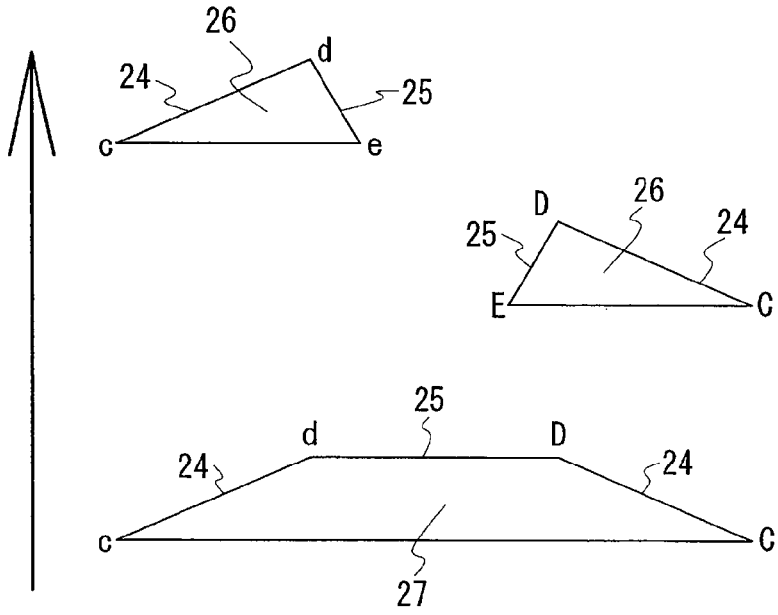
FIG. 2 is an explanatory view illustrating the procedures for knitting the shoulder portion of the knitwear according to the present invention.
Figure 3:
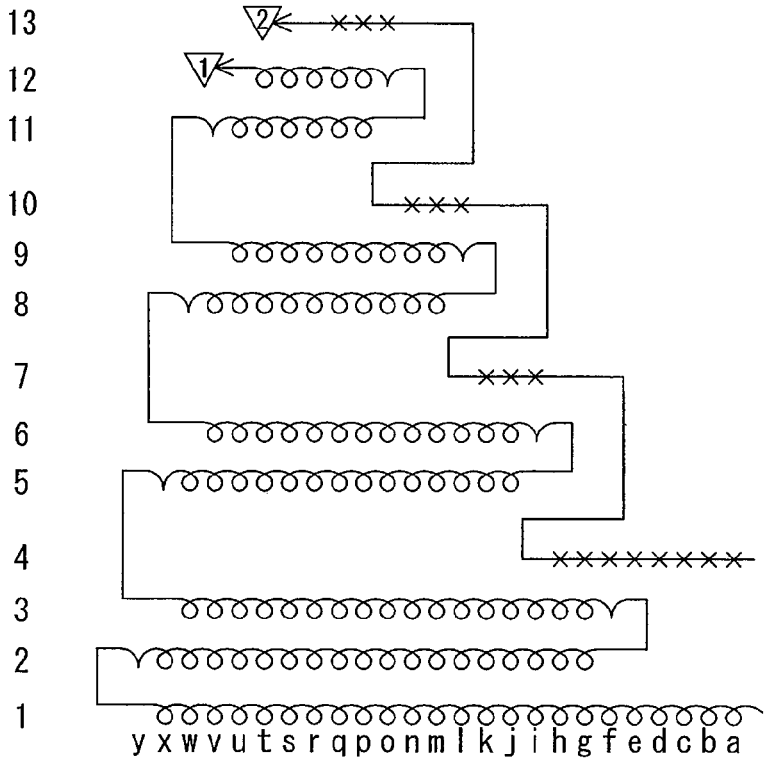
FIG. 3 is a knitting process drawing for knitting the shoulder portion of a left front body of the knitwear according to a first embodiment of the present invention.
Figure 4:
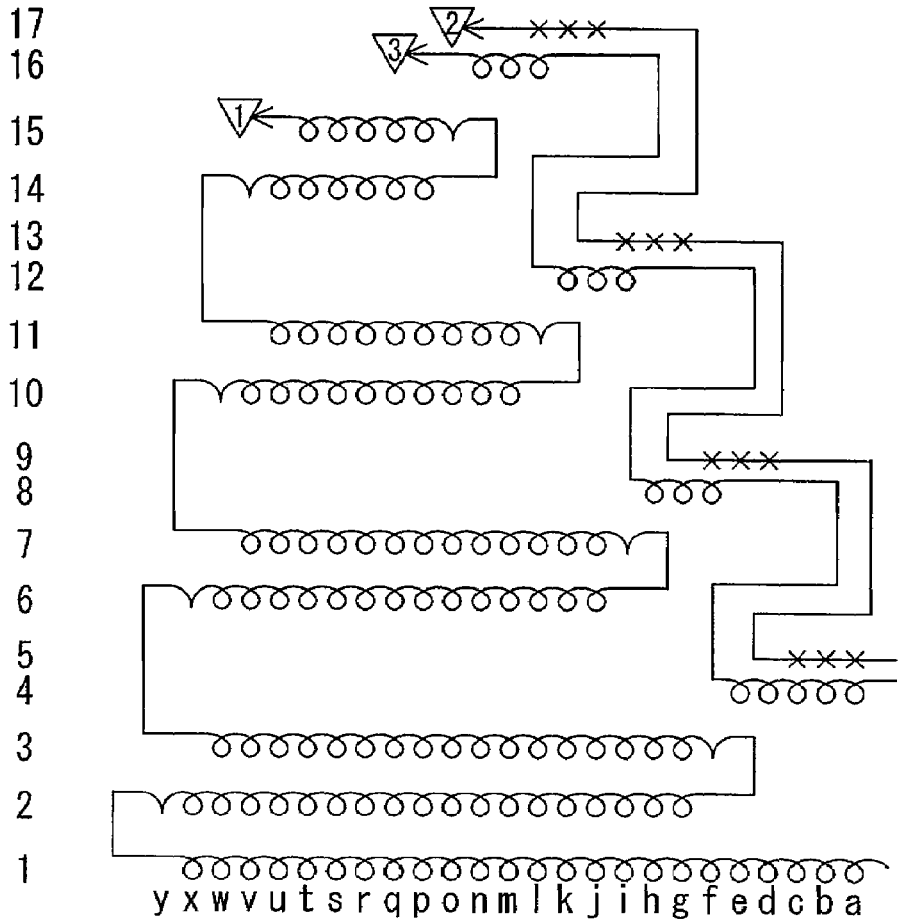
FIG. 4 is a knitting process drawing for knitting the shoulder portion of a left front body of the knitwear according to a second embodiment of the present invention.
Figure 5:
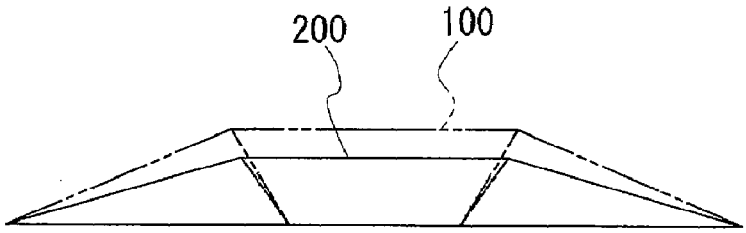
FIG. 5 is an explanatory view showing a knitted state of the shoulder portion of conventional knitwear and an ideal knitted states.

1 sweater
2*a* front body
2*b* back body
3 left sleeve
4 right sleeve
21 rib part
22 side part
23 armhole part
24 shoulder-line part
25 neckline part
26 shoulder drop knitting part
27 shoulder drop knitting part
31, 41 cuff portion
100 ideal state of shoulder portion
200 conventional shoulder portion

The invention claimed is:

1. A method of knitting a knitted fabric of performing a bind off process after flechage knitting by using a flat knitting machine having at least a pair of front and back needle beds extending in a transverse direction and disposed opposite to each other in a cross section, at least either of which is capable of being racked in the transverse direction so that loops can be transferred between the front and back needle beds, in knitting to narrow a knitting width through flechage knitting, the method comprising steps of:

knitting a predetermined number of courses less than the number of entire knitting courses in the number of entire knitting courses to be continuously knitted with flechage knitting to narrow the knitting width with flechage knitting by feeding a yarn from a flechage knitting yarn feeder, binding off at least one loop held on a knitting needle without forming a stitch at the end on the knitting width by feeding a yarn from a bind off process yarn feeder different from the flechage knitting yarn feeder, and repeating the knitting step of the predetermined number of flechage knitting course and the binding off step so that knitting width is narrowed through flechage knitting while the loops in a resting state at the end of the knitting width are sequentially bound off.

2. The method of knitting the knitted fabric according to claim 1, wherein the number of entire knitting courses to be knitted with flechage knitting is divided into at least two course groups, and the loops held on the knitting needles without forming the stitches at the end of the knitting width are bound off every time the predetermined number of courses in each course group is knitted with flechage knitting.

3. The method of knitting the knitted fabric according to claim 1, wherein in the bind off step, the loops held on knitting needles without forming the stitches at the end of the knitting width after flechage knitting are directly bound off by feeding the yarn from the bind off process yarn feeder.

4. The method of knitting the knitted fabric according to claim 1, wherein in the bind off step, a new loop as an adjustment stitch is formed on at least one loop held on the knitting needle without forming the stitch at the end of the knitting width after flechage knitting by feeding a yarn from a yarn feeder different from the flechage knitting yarn feeder and the bind off process yarn feeder, and the new loop is bound off with the yarn fed from the bind off process yarn feeder.

5. A knitting program stored on a computer-readable medium for a computer controlled flat knitting machine, to knit a knitted fabric by performing bind off process after flechage knitting by execution of knitting commands, the flat knitting machine having at least a pair of front and back needle beds extending in a transverse direction and disposed opposite to each other in a cross section, at least either of which is capable of being racked in the transverse direction so that loops can be transferred between the front and back needle beds, the knitting commands comprising:

a flechage knitting setting command for setting number of entire knitting courses to be performed with flechage knitting, group setting command for dividing the number of entire knitting courses to be performed with flechage knitting into at least two groups, and a knitting command to, in each course group, perform flechage knitting for a predetermined number of courses in each course group by feeding a yarn from a flechage knitting yarn feeder and perform bind off process on loops held on knitting needles without forming stitches at the end of a knitting width by feeding yarn from a bind off process yarn feeder different from the flechage knitting yarn feeder after the predetermined number of flechage knitting course in each course is knitted, the flechage knitting and the bind off process starting sequentially from a course group at a knitting start side.

* * * * *